US009224281B2

(12) United States Patent
Zhang

(10) Patent No.: US 9,224,281 B2
(45) Date of Patent: Dec. 29, 2015

(54) SMOKE DETECTOR SENSOR NETWORK SYSTEM AND METHOD

(71) Applicant: The Boeing Company, Chicago, IL (US)

(72) Inventor: Wei Zhang, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 81 days.

(21) Appl. No.: 14/156,213

(22) Filed: Jan. 15, 2014

(65) Prior Publication Data

US 2015/0199891 A1 Jul. 16, 2015

(51) Int. Cl.

| | |
|---|---|
| ***G08B 17/10*** | (2006.01) |
| ***G08B 19/00*** | (2006.01) |
| ***G08B 17/117*** | (2006.01) |
| ***G08B 29/18*** | (2006.01) |

(52) U.S. Cl.

CPC ..... *G08B 17/10* (2013.01); *G08B 17/117* (2013.01); *G08B 19/00* (2013.01); *G08B 29/188* (2013.01)

(58) Field of Classification Search

None

See application file for complete search history.

(56) References Cited

U.S. PATENT DOCUMENTS

| | | | | |
|---|---|---|---|---|
| 5,592,147 | A * | 1/1997 | Wong | 340/522 |
| 5,798,700 | A * | 8/1998 | Wong | 340/628 |
| 6,107,925 | A * | 8/2000 | Wong | 340/628 |
| 7,688,199 | B2 * | 3/2010 | Zhang et al. | 340/539.26 |
| 2004/0056765 | A1 * | 3/2004 | Anderson et al. | 340/522 |
| 2004/0145484 | A1 * | 7/2004 | Wagner et al. | 340/628 |
| 2005/0110633 | A1 * | 5/2005 | Lovell et al. | 340/522 |
| 2005/0200475 | A1 | 9/2005 | Chen | |

FOREIGN PATENT DOCUMENTS

DE 19845553 A1 4/2000

OTHER PUBLICATIONS

David Blake, Aircraft Cargo Compartment Smoke Detector Alarm Incidents on U.S.-Registered Aircraft, 1974-1999, U.S. Department of Transportation, Federal Aviation Administration, Jun. 2000.

14 CFR § 25.858—Cargo or baggage compartment smoke or fire detection systems, Jan. 1, 2002 edition.

FAA Advisory Circular, Smoke Detection, Penetration, And Evacuation Tests And Related Flight Manual Emergency Procedures, Jan. 6, 1994.

Giorgio Sberveglieri, Nano-structured solid-state gas sensors with superior performance, Project No. NMP4-CT-2003-001528, May 31, 2007.

(Continued)

*Primary Examiner* — Julie Lieu

(74) *Attorney, Agent, or Firm* — John S. Economou

(57) ABSTRACT

A system and method for detecting smoke in a compartment that includes a first set of sensors, a second set of sensors and a processor. Each sensor in the first set is configured to sense particles. Each sensor in the second set is configured to sense at least one gas. The processor is configured to receive first input data from the first set of sensors and second input data from the second set of sensors, to compare the second input data with a noise level when the first input data indicates that particles are present in the compartment, and to generate an alert signal when the second input data exceeds the noise level. The processor preferably calculates a rate of change of the second data and compares the second input data with the noise level only when the rate of change of the second data exceeds a third threshold.

18 Claims, 4 Drawing Sheets

(56) References Cited

OTHER PUBLICATIONS

Katherine K. Martin, New NASA Design Concept Smokes out False Alarms, NASA News, Jul. 20, 2005.
G. W. Hunter, J. C. Xu, Azlin M. Biaggi-Labiosa, B. J. Ward, P. Dutta, C. C. Liu, Smart Sensor Systems for Spacecraft Fire Detection and Air Quality Monitoring, 2011.
David Blake, Aircraft Cargo Compartment Fire Detector Certification, 3rd Triennial International Fire and Cabin Safety Research Conference, Oct. 22-25, 2001.
S . Chen, C. F. N. Cowan, and P. M. Grant, Orthogonal Least Squares Learning Algorithm for Radial Basis Function Networks, IEEE Transactions on Neural Networks, vol. 2, No. 2, Mar. 1991.
Jun. 23, 2015 EPO Search and Examination Report.

* cited by examiner

SMOKE DETECTOR SENSOR NETWORK SYSTEM AND METHOD

FIELD

The present invention relates generally to smoke and fire detection, and more particularly to systems and methods for detecting smoke and fire in aircraft cargo compartments.

BACKGROUND

Aircraft typically include at least one cargo compartment to transport goods and FAA regulations require that smoke detection systems be included in the aircraft to determine if smoke and/or fire are present in such cargo compartments. Smoke detection systems in aircraft cargo compartments have historically experienced a high incidence of false alarm rates. Some smoke detection systems used in aircraft cargo compartments consist of a network of "spot-type" particle sensor smoke detectors coupled with an alarm system. When particles are detected, the network of detectors sends alarm status signals to the alarm system, which provides a warning signal to the flight deck, where a decision may take place to initiate fire suppression and other safety systems. Other proposed smoke detection systems may employ video cameras.

The existence of particulates such as mist, dust, condensation, oil droplets and other aerosols in the cargo hold compartments and the sensitivity of current sensor systems contribute to the high false alarm rates. In some cases, the ratio of false to genuine alarms may reach 200:1. One study of verified smoke events vs. total alarms indicates that over 90% of all alarms are false due to these particulates. The direct cost of each false alarm can be very costly and may include indirect consequences such as (1) increased safety risk due to forced landings at unfamiliar or less adequate airports, (2) loss of confidence in detection systems, and (3) risk of injury to passengers and crewmembers during evacuation.

One approach to reducing false alarms has been to use a multi-sensor smoke detector package. For example, a joint project sponsored by the European Union produced such a system that includes four different types of sensors, two gas sensors, a particle sensor and a thermal sensor, in one package. In another example, NASA developed a new fire detector designed for significantly reducing the rate of false alarms aboard in cargo bay of aircraft. NASA's detection package includes miniaturized carbon monoxide and carbon dioxide sensors as well as a smoke particle sensor. The European Union and NASA multi-sensor smoke detector packages have similar approaches and should be able to effectively recognize a real fire in cargo bay. However, such systems are mounted within a package having a relatively large volume and heavy weight, and, in view of the large open space on a cargo bay in a wide body airplane, it may be difficult or impractical to place a large number of these sensor packages on the cargo bay ceiling. When multi-sensor smoke detector packages are distributed on a wide body airplane cargo bay ceiling, a resulting white space exists between each of the multi-sensor smoke detector packages. As evident, if a fire starts at an area adjacent to a portion of the white space farthest from any of the multi-sensor smoke detector packages, it will take much longer to detect than if it started directly adjacent to one of the multi-sensor smoke detector packages. As a result that there may be large open spaces on the cargo bay ceiling of the wide body airplane that are not covered by such sensors which could result in the failure to promptly identify some cargo fire events that start within the uncovered areas. In other words, if a fire starts at an area adjacent to a portion of the white space farthest from any of the multi-sensor smoke detector packages, it will take much longer to detect than if it started directly adjacent to one of the multi-sensor smoke detector packages. Other multi-sensor-based systems may face the same drawbacks.

Accordingly, a need exists in the art for improved techniques for smoke and fire hazard detection and evaluation.

SUMMARY

The present invention addresses the problems with the prior art by providing a smoke detection system that includes a first set of sensors, a second set of sensors and a processor. The first set of sensors is positioned within a compartment and configured to sense at least particles in the compartment. The second set of sensors is also positioned within the compartment and configured to sense at least one gas in the compartment. The processor is configured to receive first input data from the first set of sensors and second input data from the second set of sensors, to compare the second input data with a second predetermined threshold indicating that gas is present in the compartment when the first input data exceeds a first predetermined threshold indicating that particles are present in the compartment, and to generate an alert signal when the second input data exceeds the second predetermined threshold. In a further embodiment, the processor is also configured calculate a rate of change of the second data and to compare the second input data with the second predetermined threshold only when the rate of change of the second data exceeds a third predetermined threshold.

The compartment may be a cargo compartment in an aircraft. Preferably, there are more second sensors than first sensors. Further, the second sensors may be positioned between the first sensors. Still further, the first and second sensors may be grouped in sets, with each set including a plurality of second sensors arrayed about an associated respective first sensor. Alternatively, the first and second sensors may be grouped in sets, with each set including a plurality of second sensors radially positioned about an associated respective first sensor.

In an embodiment, the first sensors may be included within multi-sensors that detect particles, heat and gas, while the second sensors detect CO and/or CO2. Further, the second sensors may be nano-technology gas sensors.

Preferably, the processor uses a radial basis function to process the first input data and the second input data. In addition, the second predetermined threshold preferably comprises a noise level of gas in the compartment determined from the second input data when the first input data is below the first predetermined threshold.

The present invention also is addressed to a method for detecting smoke within a compartment using a smoke detection system including a first set of sensors positioned within a compartment and configured to sense at least particles in the compartment and a second set of sensors positioned within the compartment and configured to sense at least one gas in the compartment. In the method, first input data is received from the first set of sensors and second input data is received from the second set of sensors. The first input data is compared to a first predetermined threshold to determine if particles are present in the compartment. If the first input data exceeds the first predetermined threshold, the second input data is compared with a second predetermined threshold indicating that gas is present in the compartment. If the second input data exceeds the second predetermined threshold, smoke is determined to be present in the compartment. Preferably, an alert signal is provided when smoke is determined to be present in the compartment.

In a further embodiment, a rate of change of the second data is calculated and the second input data is compared with the second predetermined threshold only when the rate of change of the second data exceeds a third predetermined threshold. In another embodiment, a noise level of gas in the compartment is determined from the second input data when the first input data is below the first predetermined threshold and the second predetermined threshold is set to the determined noise level of gas. In a still further embodiment, the second input data is compared with the second predetermined threshold by calculating a gas level concentration signal using a radial basis function, and comparing the gas level concentration signal with the second predetermined threshold.

BRIEF DESCRIPTION OF THE DRAWINGS

The following detailed description, given by way of example and not intended to limit the present invention solely thereto, will best be understood in conjunction with the accompanying drawings in which.

DETAILED DESCRIPTION

In the present disclosure, like reference numbers refer to like elements throughout the drawings, which illustrate various exemplary embodiments of the present invention.

Figure 1:
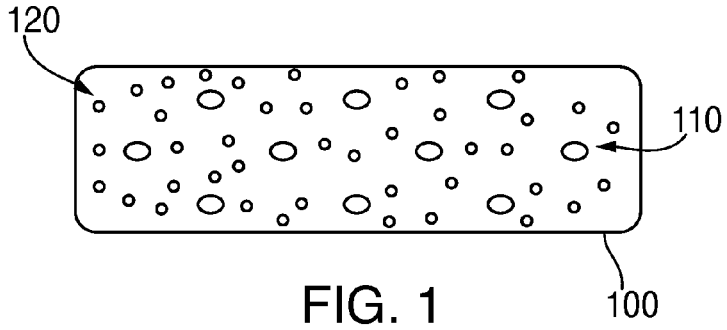
FIG. 1 is a diagram showing the distribution of multi-sensor smoke detector packages and nano-technology gas sensors on a wide body airplane cargo bay ceiling according to an aspect of the present invention.

Referring now to the drawings and in particular to FIG. 1, the smoke/fire detection system disclosed herein uses discrete gas sensors 120 mounted on the cargo bay cabin ceiling 100 to supplement an array of particle sensors 110 (which may be included as part of a multi-sensor smoke detector package) to reduce the false alarm rate of the prior art systems which use only particle sensors. The particle sensors 110 may be conventional particle sensors or part of a multi-sensor package that includes a particle sensor 110. The gas sensors 120 are preferably based on nanotechnology and detect carbon monoxide (CO) gas and/or carbon dioxide (CO2) gas. As such, the gas sensors 120 do not add much weight to the smoke detection system while covering the "white space" between the particle sensors. By adding the lightweight and relatively inexpensive gas sensors, the system disclosed herein provides a much more economical and lightweight solution than simply adding additional multi-sensor packages to the cargo bay ceiling in an effort to cover the white space in the cargo bay ceiling.

Figure 2:
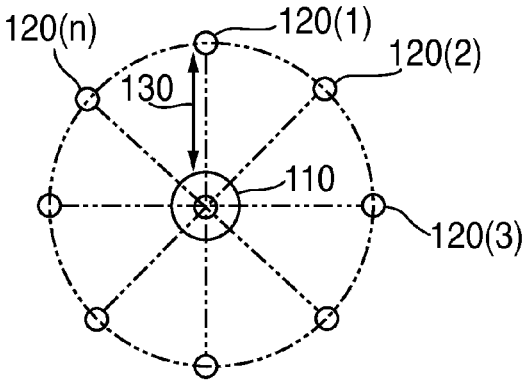
FIG. 2 is a diagram showing the combination of a multi-sensor smoke detector package and nano-technology gas sensors according to an embodiment of the present invention.

In the exemplary embodiment, a plurality of gas sensors are arrayed around each particle sensor. For example, as shown in FIG. 2, several gas sensors 120(1) to 120(n) (n=8 in FIG. 2) are evenly radially positioned around one particle sensor 110, each of the gas sensors 120 positioned a fixed distance l (130) from the central particle sensor 110. Each of the particle sensors 110 shown in FIG. 1 preferably includes the same type of arrangement in the exemplary embodiment, i.e., with a predetermined number of associated gas sensors positioned a fixed distance apart from the particle sensor 110.

Figure 3:
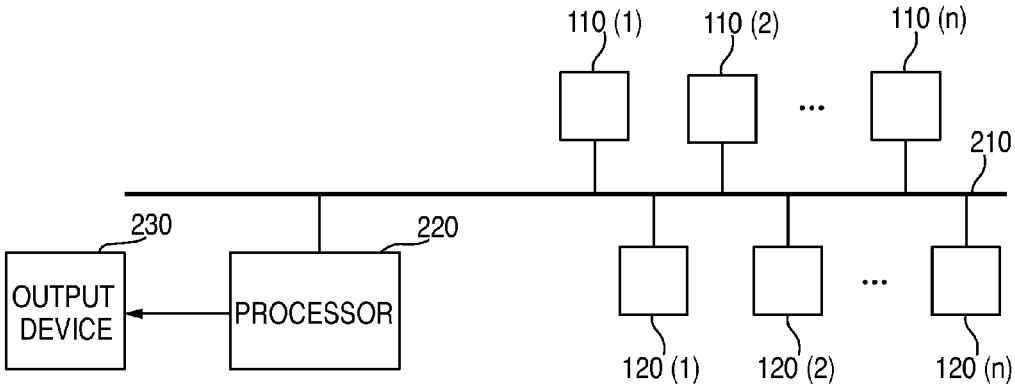
FIG. 3 is a block diagram of a complete smoke and fire detector system according to an embodiment of the present invention.

As shown in FIG. 3, the particle sensors 110 and gas sensors 120 are networked together on a network 210 such that a central processor 220 receives both particle input data and gas input data from particle sensors 110 and gas sensors 120 in real time. In the exemplary embodiment, processor 220 uses a radial basis function (RBF) to combine the input data and to determine if smoke is present in the cargo bay where the particle sensors 110 and gas sensors 120 are mounted. The RBF is selected because of its non-linear component that can catch a very fast increase in smoke concentration. The processor 220 is configured to first determine a CO/CO2 noise level in the cargo compartment (e.g., if animals are in the bay the noise level of CO/CO2 may be higher than a compartment without animals). The processor 220 then receives the particle input data and gas input data to determine if the CO/CO2 level is increasing compared to the noise level. When the CO/CO2 level is higher than the noise level, a fire may be present in the compartment. The processor 220 then uses the RBF to determine a CO/CO2 level at a center point, such as at a selected one of the particle detectors 110. The particle input data is then used as a check to determine if a fire may be present. The particle input data is used as a check because more gas input data is available due to the higher number of gas sensors. If the particle input data indicates that particles are present, the gas input data is used as a check in a feedback loop until the CO/CO2 concentration level increases as described above. Alarms are sent to the cockpit via an output device 230 in real-time (within about 5 seconds of receipt of the sensor data) because the calculations performed by the processor are not very complex and can be completed quickly. Output device 230 may be a display (or portion of a display) that is used to provide status information to the pilots. In addition (or in the alternative), output device 230 may also provide an audible alarm signal upon detection of an actual alarm condition.

Preferably, the sensor network system disclosed herein combines advanced gas sensor technology with a multi-sensor package. The advanced gas sensor technology provides highly sensitive, selective and stability characteristics in a very small volume and a lighter weight. One example sensor is a nanotechnology-based metal oxide gas sensor. Other types of sensors which may be used with the system disclosed herein include: (1) photo ionization detector; (2) electrochemical sensor; (3) fiber-optical sensor; and (4) differential mobility spectrometry-based sensors. As one of ordinary skill in the art will readily recognize, other sensor technologies may also be used. The key requirement for such sensors is the ability to sense very low concentrations of CO and/or CO2 from the very beginning of a smoke/fire event in the cargo bay. The nanotechnology-based metal oxide sensor provides certain advantages because of its reliability, low-power requirements, compact size and mass, selectivity, sensitivity, response-time and stability.

Processor 220 is programed to implement a radial basis function (RBF) to process the signals received from the sensor network comprising signals from sensors 110, 120. In particular, processor 220 is configured as part of an artificial neural network that uses radial basis functions as activation functions.

An RBF is a network that can be regarded as a special two-layer network which is linear in the parameters by fixing each RBF center and non-linearity in a hidden layer. The hidden layer performs and maps the input space onto a new space. The output layer then implements a liner combiner on this new space and the only adjustable parameters are the weights of this linear combiner. These parameters then can be determined using the linear least square (LS) method, which is an important advantage of RBF for application to the sensor network disclosed herein.

Figure 4:
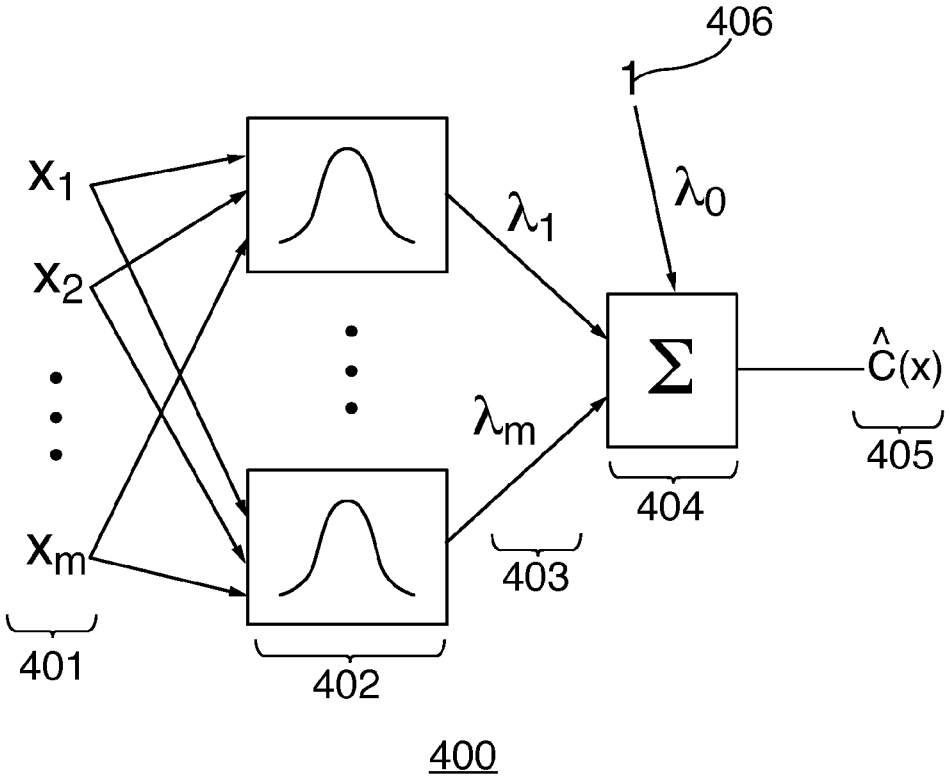
FIG. 4 is a diagram of a radial basis function network used in an embodiment of the present invention.

Referring now to FIG. 4, an RBF network 400 is shown with inputs X1, X2, . . . Xm (401), and an output $\hat{C}(x)$ 405. The arrowed lines 403 in FIG. 4 symbolize parameters $\lambda_i$ in the network. The RBF network 400 consists of one hidden layer 402 of basic functions, or neurons. At the input of each neuron, the distance between the neuron center and the input vector is calculated. The output of the neuron is then formed by applying a basis function to this distance. The RBF network output is formed by a weighted sum 404 of the neuron outputs and the unity bias 406 shown. The RBF network 400 is often complemented with a linear part which corresponds to additional direct connections from the inputs to the output neuron. Mathematically, the RBF network, including a linear part, produces an output given by $$\hat{C}(x) = \lambda_0 + \sum_{i=1}^{M} \lambda_i \phi(\|\vec{x} - C_i\|) \tag{1}$$

where: λis weight parameters (0~M);

$C_i$ is the fixed RBF center points;

$\vec{x}$ is the input vector, and

ϕ is a non-linearity fixed function.

The function ϕ is often be selected as the Gaussian function:

$$\phi(v)=\exp(-v^2/\beta^2), \tag{2}$$

where: β is a real constant;

for $v \to \infty$, $\phi(v) \to 0$.

The value of the weight parameters 80 $_i$ (i=1,M) can be determined by the Linear Least Squares Algorithm (LLSA). Note that the parameters $\lambda_i$ (i=1,M) are often lumped together in a common variable to make the notation compact.

According to the presently preferred embodiment, the smoke detector sensor network system and method deploys a combination of multi-sensor packages 110 and nanotech based metal oxide gas sensors 120 (FIG. 1) which are coupled to a central processor configured to implement a radial basis function network as detailed below to determine when a smoke condition occurs in the area adjacent to the multi-sensor packages 110 and nanotech based metal oxide gas sensors 120. In particular, the multi-sensor packages 110 (which includes at least a gas sensor and a particle sensor) and a number of nanotech based metal oxide gas sensors 120 are grouped in subsets, with a number n (e.g., n=8 as in FIG. 2) of nanotech based metal oxide gas sensors 120 paired with a single multi-sensor package 110 in each subset. The central processor 220 is preferably configured to process each group of sensors (i.e., each subset) according to the steps outlined in the flowchart of FIG. 5.

Figure 5:
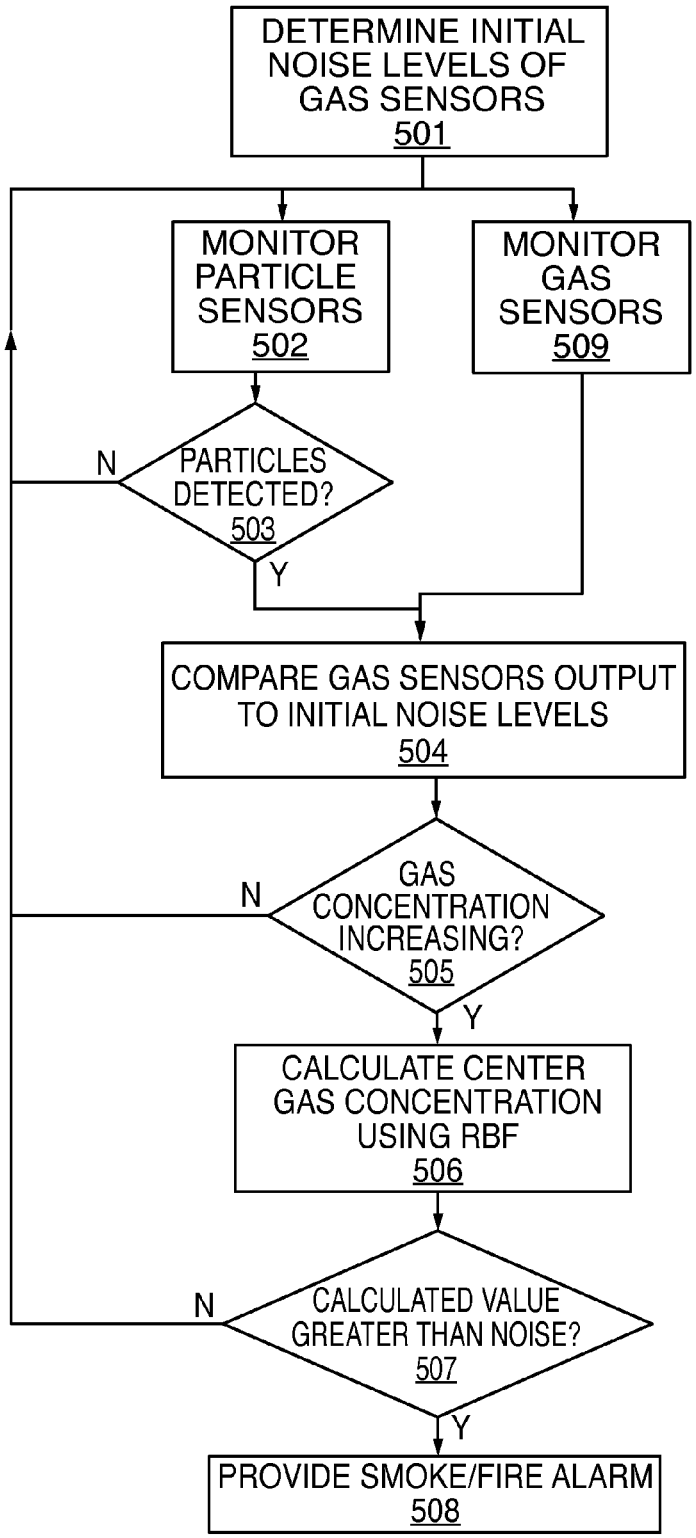
FIG. 5 is a flowchart showing the operation of an embodiment of the present invention in detecting a smoke/fire event.

First, at step 501 in FIG. 5, the initial noise level concentration of gas (e.g., CO/CO2) with a no-smoke condition is determined for the grouping shown in FIG. 2. In a presently preferred embodiment, this is done by comparing the value at the center sensor ($C_0$) with the values at each of the outer sensors ($C_i$) at a single point in time (equation 1 below) and dividing by the length 1 between the center sensor and the outer sensors and by comparing the value at each sensor over time t (equation 2 below applies to the outer sensors while equation 3 below applies to the center sensor). As one of ordinary skill in the art will readily recognize, there are other ways of calculating the initial noise level concentrations of gas in the cargo bay compartments.

$$\Delta Cd_i = \frac{\partial C_i}{\partial l} = \frac{C_0 - C_i}{l} \tag{1}$$

$$\Delta Ct_i = \frac{\partial C_i}{\partial t} = \frac{C_i^{t+1} - C_i^t}{\Delta t} \tag{2}$$

$$\Delta Ct_o = \frac{\partial C_o}{\partial t} = \frac{C_o^{t+1} - C_o^t}{\Delta t} \tag{3}$$

The values of $\Delta Cd_i$, $\Delta Ct_i$, and $\Delta Ct_0$ are the gas (CO/CO2) concentration gradients between the center multi-sensor package 110 and the outer nanotech based metal oxide gas sensors 120 (gradients over spacing and over time) during a no-smoke condition. These values are preferably considered as the initial noise level.

The noise level gas (CO/CO2) concentration can be calculated using the following approach. An averaged concentration from all nodes is calculated:

$$\overline{C}_d = \frac{1}{M+1}\left(\sum_{i=1}^{M} C_i + C_O\right) \tag{4}$$

Then the standard deviation for the concentration from all nodes can be calculated:

$$\delta C_{d-a} = \sqrt{\frac{1}{M+1}\left(\sum_{i=1}^{M} (C_i - \overline{C}_d) + (C_o - \overline{C}_d)\right)^2} \tag{5}$$

$$\overline{C}_{dt} = \frac{1}{(t_1 - t_0)} \int_{t0}^{t1} \overline{C}_d(t) dt \tag{6}$$

$$\delta C_{(d-a)max} = \mathrm{Max}\{\delta C_{(d-a)}(t)d\}_{t0}^{t1} \tag{7}$$

Further, it is assumed the noise level of the gas concentrations include the following parts:

(a) Mean concentration noise level:

$$\overline{C}d_{noise}=\max\{|\overline{C}_{dt},\overline{C}_d|\} \tag{8}$$

(b) Max concentration noise level:

$$Cd_{max-noise}=\overline{C}d_{noise}+\delta C_{(d-1)max} \tag{9}$$

(c) Concentration gradient noise level on space:

$$dCdl_{noise}=\max\{\Delta Cd_{i(i=1,M)}\} \tag{10}$$

(d) Concentration gradient noise level on time history, $$dCdt_{noise}=\max\{|\max(\Delta Ct_i,\Delta Ct_o)|,|(dCd_{noise}^{n+1}-dCd_{noise}^{n})/\Delta t)|\} \tag{11}$$

After the initial noise levels of the gas sensors are determined (step 501 in FIG. 5), processor 220 separately monitors the outputs of the particle and gas sensors (steps 502 and 509) and determines if particles have been detected (step 503) by, preferably, comparing the received particle sensor signals with a predetermined threshold. As shown in FIG. 5, processor 220 also determines, in parallel fashion via steps 504 to 507 explained below, whether gas has been detected by continually checking the received gas sensor signals indicate a smoke event. As shown in the flowchart of FIG. 5, the system loops between steps 502 and 503 until particles have been detected and between steps 502 and 509 until gas has been detected, whereupon processing proceeds to step 504. The parallel nature of such comparisons ensures that the earliest possible detection of a smoke event occurs, since it could be possible that a gas sensor may signal an increase in gas in the compartment before the particle sensors signal an increase in particles in the compartment.

At steps 504 and 505, the gas (CO/CO2) concentrations are compared with the initial noise levels to determine if the gas concentration levels are increasing. Preferably, this is done by the following two comparisons:

$$\text{If } \mathrm{Max}C_i(i=1, M) > Cd_{max-noise} \quad (8)$$

and if $$|\Delta Cd_i| = \left|\frac{\partial C_i}{\partial l}\right| = \left|\frac{C_0 - C_i}{l}\right| > dCdl_{noise},$$

$$\text{If } |\Delta Ct_i| = \left|\frac{\partial C_i}{\partial t}\right| > dCdt_{noise} \quad (9)$$

and $$|\Delta Ct_o| = \left|\frac{\partial C_o}{\partial t}\right| > dCdt_{noise}$$

Although both comparisons are preferable to provide more accurate results, one of ordinary skill in the art will readily recognize that comparison (8) or comparison (9) alone may provide satisfactory results. Note that when the smoke event in the cargo compartment occurs closer to the outer sensors, then $|\Delta Ct_i|>|\Delta Ct_o>dCdt_{noise}$, while when the smoke event in the cargo compartment occurs closer to the central multi-sensor package, then $|\Delta Ct_o|>|\Delta Ct_i>dCdt_{noise}$. In either case, both values (i.e., $|\Delta Ct_o|,|\Delta Ct_i|$) will be greater than $dCdt_{noise}$ during a possible smoke event. If the comparison of step 505 shows that the gas concentration is not increasing, processing loops back to step 502. If the comparison of step 505 shows that the gas concentration is increasing, processing moves to step 506.

Once possible smoke signals have been identified using a particle sensor and after confirming that the gas concentrations in the cargo area are increasing (steps 504, 505), a radial basis function is used to determine the converted gas (CO/CO2) concentration at the center point at step 506. Based on BRF theory, the following converter equation is used to determine the converted concentration at the center point:

$$\hat{C}(x)_O = \lambda_0 + \sum_{i=1}^{M} \lambda_i \phi(\|\vec{x} - C_i\|) \quad (10)$$

At step 507, the value calculated at step 506 is compared with the noise levels to determine if a smoke event should be reported. Preferably, the gradient of the converted concentration is compared to the noise level as follows:

$$|\Delta \hat{C}t| = \left|\frac{\partial \hat{C}(x)_O}{\partial t}\right| = \left|\frac{\hat{C}(x)_O^{n+1} - \hat{C}(x)_O^{n}}{\Delta t}\right| > dCdt_{noise} \quad (11)$$

When equation (11) is satisfied, the system provides a smoke/fire alarm signal, via output device 230, to the cockpit at step 508. If equation (11) is not satisfied, then processing loops back to step 502.

The system disclosed herein will significantly reduce the false alarm rates of prior art smoke and fire detection. By using the radial basis function, the system provides a fire/smoke signal in real time, thereby providing the flight crew with much quicker status information of the cargo environment with respect to the existence of possible smoke/fire events therein.

The figures include block diagram and flowchart illustrations of methods and systems according to the preferred embodiment. It will be understood that each block in such figures, and combinations of these blocks, can be implemented by computer program instructions. These computer program instructions may be loaded onto a computer or other programmable data processing apparatus to produce a machine, such that the instructions which execute on the computer or other programmable data processing apparatus create means for implementing the functions specified in the block or blocks. These computer program instructions may also be stored in a computer-readable medium or memory that can direct a computer or other programmable data processing apparatus to function in a particular manner, such that the instructions stored in the computer-readable medium or memory produce an article of manufacture including instruction means which implement the function specified in the block or blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the block or blocks.

Those skilled in the art should readily appreciate that programs defining the functions of the present invention can be delivered to a computer in many forms; including, but not limited to: (a) information permanently stored on non-writable storage media (e.g. read only memory devices within a computer such as ROM or CD-ROM disks readable by a computer I/O attachment); (b) information alterably stored on writable storage media (e.g. floppy disks and hard drives); or (c) information conveyed to a computer through communication media for example using wireless, baseband signaling or broadband signaling techniques, including carrier wave signaling techniques, such as over computer or telephone networks via a modem.

Although the present invention has been particularly shown and described with reference to the preferred embodiments and various aspects thereof, it will be appreciated by those of ordinary skill in the art that various changes and modifications may be made without departing from the spirit and scope of the invention. It is intended that the appended claims be interpreted as including the embodiments described herein, the alternatives mentioned above, and all equivalents thereto.

What is claimed is:

1. A smoke detection system comprising:

a first set of sensors positioned within a compartment, the first set of sensors configured to sense at least particles in the compartment;

a second set of sensors positioned within the compartment, the second set of sensors configured to sense at least one gas in the compartment;

a processor configured to receive first input data from the first set of sensors and second input data from the second set of sensors, to compare the second input data with a second predetermined threshold indicating that gas is present in the compartment when the first input data exceeds a first predetermined threshold indicating that particles are present in the compartment, and to generate an alert signal when the second input data exceeds the second predetermined threshold; and wherein the processor uses a radial basis function to process the first input data and the second input data.

2. The smoke detection system of claim 1, wherein the processor is also configured calculate a rate of change of the second data and to compare the second input data with the second predetermined threshold only when the rate of change of the second data exceeds a third predetermined threshold.

3. The smoke detection system of claim 1, wherein the compartment is a cargo compartment in an aircraft.

4. The smoke detection system of claim 1, wherein there are more second sensors than first sensors.

5. The smoke detection system of claim 4, wherein the second sensors are positioned between the first sensors.

6. The smoke detection system of claim 4, wherein the first and second sensors are grouped in sets, with each set including a plurality of second sensors arrayed about an associated respective first sensor.

7. The smoke detection system of claim 4, wherein the first and second sensors are grouped in sets, with each set including a plurality of second sensors radially positioned about an associated respective first sensor.

8. The smoke detection system of claim 1, wherein the first sensors are included within multi-sensors that detect particles, heat and gas, and wherein the second sensors detect CO and/or CO2.

9. The smoke detection system of claim 1, wherein the second sensors are nano-technology gas sensors.

10. The smoke detection system of claim 1, wherein the second predetermined threshold comprises a noise level of gas in the compartment determined from the second input data when the first input data is below the first predetermined threshold.

11. A method for detecting smoke within a compartment using a smoke detection system including a first set of sensors positioned within a compartment and configured to sense at least particles in the compartment and a second set of sensors positioned within the compartment and configured to sense at least one gas in the compartment, the method comprising the steps of:

receiving first input data from the first set of sensors;

receiving second input data from the second set of sensors;

comparing the first input data to a first predetermined threshold to determine if particles are present in the compartment;

if the first input data exceeds the first predetermined threshold, comparing the second input data with a second predetermined threshold to determine if gas is present in the compartment;

determining that smoke is present in the compartment when the second input data exceeds the second predetermined threshold; and wherein the step of comparing the second input data with a second predetermined threshold comprises the steps of:

calculating a gas level concentration signal using a radial basis function, and comparing the gas level concentration signal with the second predetermined threshold.

12. The method of claim 11, further comprising the step of:

calculating a rate of change of the second data, and wherein the step of comparing the second input data with the second predetermined threshold is performed only when the rate of change of the second data exceeds a third predetermined threshold.

13. The method of claim 11, further comprising the steps of:

determining a noise level of gas in the compartment from the second input data when the first input data is below the first predetermined threshold, and setting the second predetermined threshold to the determined noise level of gas.

14. The method of claim 11, further comprising the step of providing an alert signal when the determining step determines that smoke is present in the compartment.

15. The method of claim 11, wherein there are more second sensors than first sensors.

16. The method of claim 15, wherein the second sensors are positioned between the first sensors.

17. The method of claim 15, wherein the first and second sensors are grouped in sets, with each set including a plurality of second sensors arrayed about an associated respective first sensor.

18. The method of claim 15, wherein the first and second sensors are grouped in sets, with each set including a plurality of second sensors radially positioned about an associated respective first sensor.

* * * * *